US007956812B2

(12) United States Patent
Chen et al.

(10) Patent No.: US 7,956,812 B2
(45) Date of Patent: Jun. 7, 2011

(54) WIDE-BAND ANTENNA AND MANUFACTURING METHOD THEREOF

(75) Inventors: Yean-Cheng Chen, Taipei (TW); Chih-Ming Wang, Taipei (TW); Kuan-Hsueh Tseng, Taipei (TW)

(73) Assignee: Winstron Neweb Corp., Taipei (TW)

( * ) Notice: Subject to any disclaimer, the term of this patent is extended or adjusted under 35 U.S.C. 154(b) by 254 days.

(21) Appl. No.: 12/469,221

(22) Filed: May 20, 2009

(65) Prior Publication Data

US 2010/0039329 A1 Feb. 18, 2010

(30) Foreign Application Priority Data

Aug. 12, 2008 (TW) ..... 97130719 A
Oct. 28, 2008 (TW) ..... 97141360 A

(51) Int. Cl.
*H01Q 1/38* (2006.01)

(52) U.S. Cl. ..... 343/700 MS

(58) Field of Classification Search ..... 343/700 MS, 343/702, 850, 853, 846, 848
See application file for complete search history.

(56) References Cited

U.S. PATENT DOCUMENTS 6,762,723 B2 * 7/2004 Nallo et al. ..... 343/700 MS
7,423,598 B2 * 9/2008 Bit-Babik et al. ..... 343/702
7,834,809 B2 * 11/2010 Tseng et al. ..... 343/700 MS
2008/0165061 A1 * 7/2008 Lin et al. ..... 343/700 MS
2008/0198089 A1 * 8/2008 Hsiao et al. ..... 343/850

* cited by examiner

*Primary Examiner* — Huedung Mancuso
(74) *Attorney, Agent, or Firm* — Thomas, Kayden, Horstemeyer & Risley, LLP

(57) ABSTRACT

A wide-band antenna and a manufacturing method thereof are provided. The wide-band antenna includes a substrate, a first radiator, a second radiator, a grounding portion, and a signal feeding portion. The first radiator is disposed on a first surface of the substrate while the second radiator is disposed on the first surface or a second surface opposite to the first surface. The first radiator and the second radiator are spaced apart by a predetermined distance. The grounding portion is disposed on the substrate to couple with the second radiator. The signal feeding portion has a coupling unit disposed on the second surface and at least partially overlapping the first radiator. The signal feeding portion is coupled with the grounding portion and feeds signals to excite the first radiator to form a first band mode through coupling effect by the coupling unit. The first radiator feeds signals to excite the second radiator to form a second band mode by coupling effect.

29 Claims, 10 Drawing Sheets

WIDE-BAND ANTENNA AND MANUFACTURING METHOD THEREOF

This application claims priority based on a Taiwanese patent application No. 097130719, filed on Aug. 12, 2008, and a Taiwanese patent application No. 097141360, filed on Oct. 28, 2008, the disclosures of which are incorporated herein by reference in its entirety.

BACKGROUND OF THE INVENTION

1. Field of the Invention

The present invention relates to a wide-band antenna and a manufacturing method thereof. More particularly, the present invention relates to a wide-band antenna for transmitting wireless communication network signals and a manufacturing method thereof.

2. Description of the Related Art

With the progress of science and technology, human's technology in wireless communication keeps progressing. In recent years, a variety of wireless communication network technologies and standards have been continuously released, which includes, for example, the Wi-Fi wireless network standard defined in IEEE 802.11 by IEEE earlier and the Worldwide Interoperability for Microwave Access (WiMAX) standard defined in IEEE 802.16 lately. Therefore, the quality and the quantity of wireless communications are both improved enormously. Especially for WiMAX, the transmission distance has been increased from meters to kilometers, and the bandwidth becomes wider over the prior art.

In order to comply with the progress of wireless communication network technology, the antennas for receiving/transmitting wireless signals therefore need to be enhanced. FIG. 1 illustrates a conventional dual-frequency antenna which is disclosed in U.S. Pat. No. 6,861,986. This dual-frequency antenna includes a first radiator 31 and a second radiator 32, both connected to a ground surface 4. Signals are fed through the core conductor 61 directly to excite the first radiator 31 to form a high frequency mode with a center frequency of 5.25 GHz. The direct-feed-in signal can also excite the second radiator 32 to form a low frequency mode with a center frequency of 2.45 GHz. Besides, the length of the second radiator 32 is about a quarter (¼) of a wavelength at its operating frequency.

The antenna is fed with signals by the direct-feed-in with a bandwidth of about 200 MHz in the low frequency mode, and accordingly, the demand for wider bandwidth of WiMAX can not be fulfilled. Moreover, for compliance with the operating frequency of the low frequency mode, the length of the second radiator 32 can not be reduced to accommodate the demand for miniaturization of electronic devices.

SUMMARY OF THE INVENTION

An object of this invention is to provide an antenna with a wider bandwidth and manufacturing methods thereof.

Another object of this invention is to provide a wide-band antenna of a smaller size and lesser demand for space and a manufacturing method thereof.

A wide-band antenna includes a substrate, a first radiator, a second radiator, a grounding portion, and a signal feeding portion. The substrate has a first surface and a second surface which are opposite to each other. The first radiator is disposed on the first surface of the substrate, while the second radiator is selectively disposed on the first surface or the second surface of the substrate. The second radiator and the first radiator are spaced apart by a predetermined distance. The grounding portion is disposed on the first surface or the second surface and coupled with the second radiator. The projections of the second radiator and the grounding portion on the first surface define a semi-open region, and at least a portion of the first radiator extends into the semi-open region.

The signal feeding portion feeds the signals from a signal source to excite the first radiator and the second radiator to produce operating modes for receiving/transmitting wireless signals. Because the antenna of this invention makes use of the coupling effect to feed signal, the signal feeding portion includes a coupling unit. In one embodiment, the coupling unit is disposed on the second surface of the substrate, i.e. the surface different from the first radiator, and at least partially overlaps the first radiator. The signal feeding portion is coupled with the grounding portion and feeds signals to excite the first radiator to form a first band mode through the coupling effect by the coupling unit. The first radiator further feeds signals to excite the second radiator to form a second band mode by coupling effect.

The manufacturing method of a wide-band antenna includes the following steps: disposing a first radiator on a first surface of a substrate; disposing a second radiator on the first surface or a second surface of the substrate to be spaced apart from the first radiator by a predetermined distance; disposing a grounding portion on the substrate to couple with the second radiator; disposing a signal feeding portion including a coupling unit; feeding signals to excite the first radiator to form a first band mode through coupling effect by the coupling unit; and enabling the first radiator to feed signals to excite the second radiator to form a second band mode by coupling effect.

DETAILED DESCRIPTION OF THE PREFERRED EMBODIMENT

The present invention provides a wide-band antenna and a manufacturing method thereof. In a preferred embodiment, the wide-band antenna of the invention is applicable to various electronic devices to receive/transmit wireless signals. The electronic devices preferably include notebook computers, desktop computers, motherboards, mobile phones, personal digital assistants, electronic game devices, etc. The applications of the wireless signal received/transmitted include wireless local area network (WLAN), Worldwide Interoperability for Microwave Access (WIMAX), other wireless communication protocols, global positioning system, short-term wireless device connection, and other technologies in need of antennas.

Figure 1:
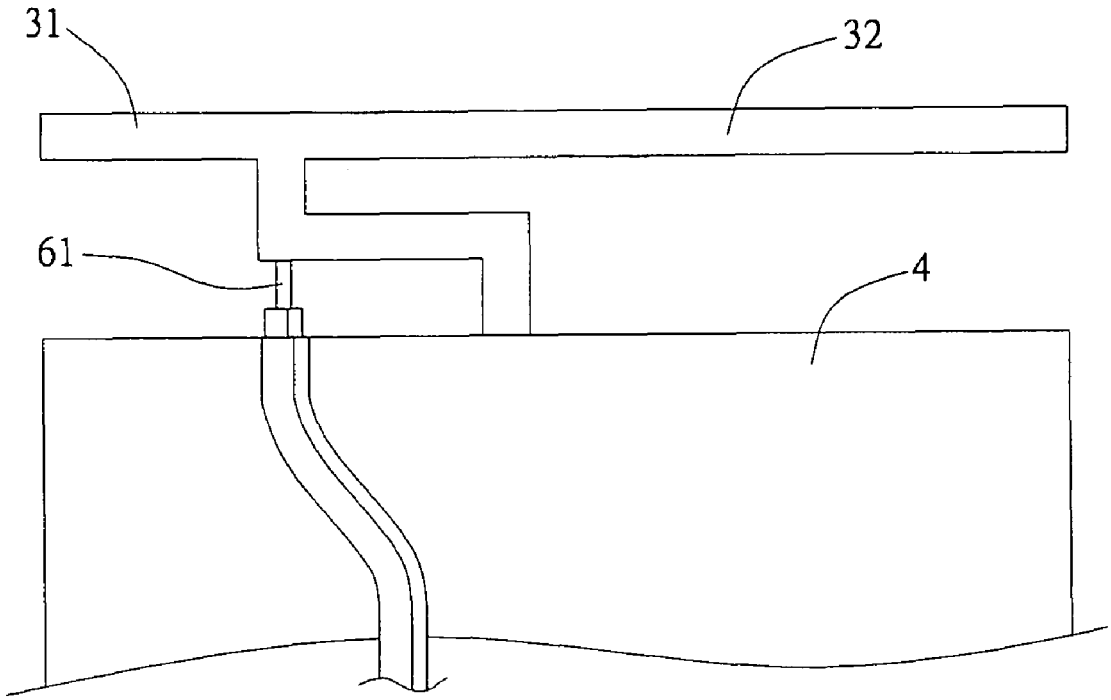
FIG. 1 (PRIOR ART)
FIG. 1 illustrates a schematic view of a conventional dual-frequency antenna.
Figure 2A:
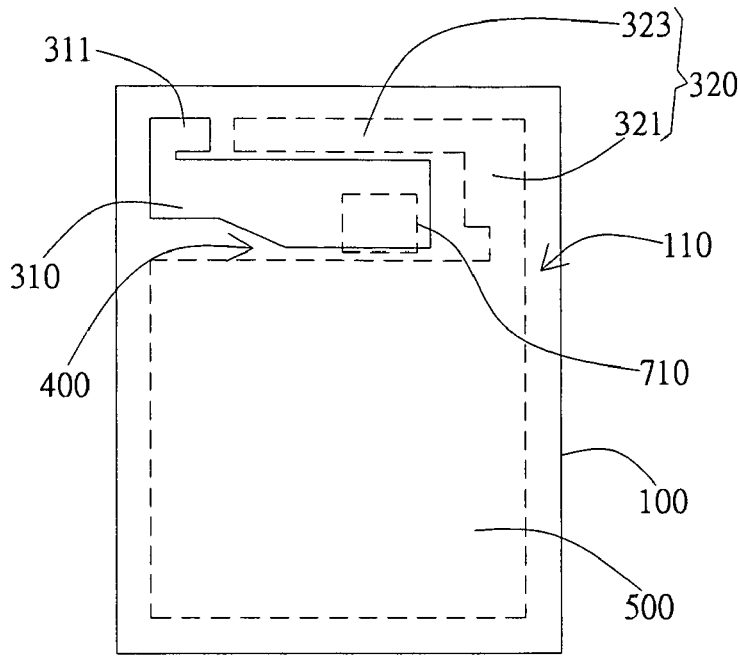
FIG. 2A illustrates a schematic view of a first surface of a wide-band antenna in accordance with one embodiment of the invention.
Figure 2B:
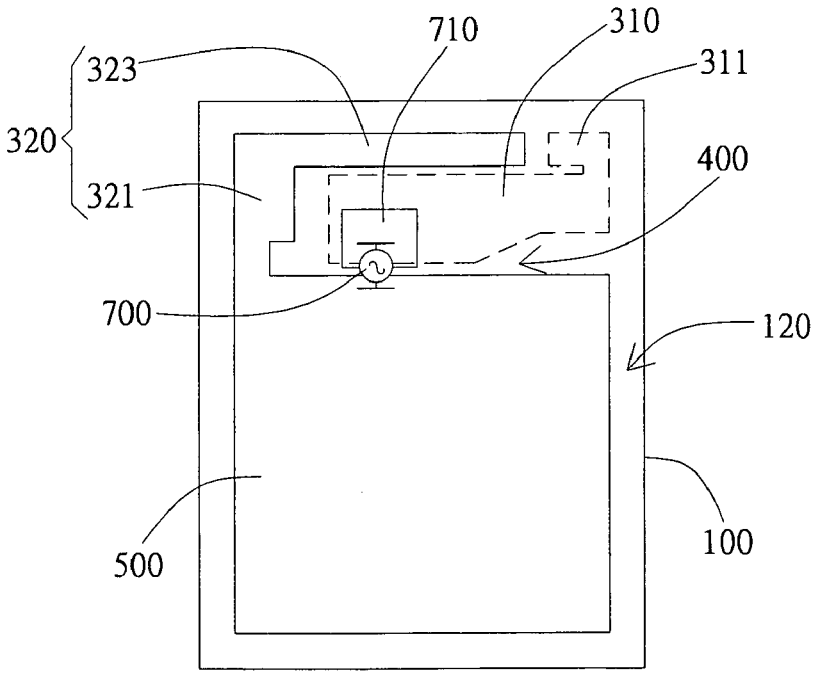
FIG. 2B illustrates a schematic view of a second surface of the embodiment shown in FIG. 2A.

FIG. 2A and FIG. 2B illustrate schematic views of a wide-band antenna in accordance with one embodiment of the invention. As shown in FIG. 2A and FIG. 2B, the wide-band antenna includes a substrate 100, a first radiator 310, a second radiator 320, a grounding portion 500, and a signal feeding portion 700. The substrate 100 is preferably made of plastics, such as polyethylene terephthalate (PET) or other dielectric materials. For example, printed circuit boards (PCBs), flexible printed circuit boards (FPC), etc. can be adopted as the substrate 100. In an embodiment, the thickness of the substrate 100 is larger than, but not limited to, 0.1 mm. The substrate 100 includes a first surface 110 and a second surface 120 which are opposite to each other. FIG. 2A illustrates an embodiment of the first surface 110, while FIG. 2B illustrates a corresponding arrangement of the second surface 120.

As shown in FIG. 2A, the first radiator 310 is disposed on the first surface 110 of the substrate 100. In an embodiment, the first radiator 310 is a metal wire or a metal microstrip in other geometric shapes which is formed on the first surface 110. The first radiator 310 is preferably formed on the first surface 110 through printing. However, in other embodiments, the first radiator 310 can be formed by any suitable methods. Besides, the area and the shape of the first radiator 310 can be adjusted in accordance with the impedance matching requirement.

The second radiator 320 can be disposed on either the first surface 110 or the second surface 120 and is preferably a printed metal wire or a metal microstrip formed by printing. The size and the shape of the second radiator 320 can be adjusted in accordance with the impedance matching requirement. As shown in FIG. 2A and FIG. 2B, the second radiator 320 is disposed on the second surface 120. In such a case, the second radiator 320 and the first radiator 310 are located on two opposite surfaces respectively. In one embodiment, the second radiator 320 and the first radiator 310 are spaced apart by a predetermined distance. As shown in FIG. 2A, there is no overlap between the projections of the second radiator 320 and the first radiator 310, and a distance is kept between the two radiators 310 and 320. However, in another embodiment, when the second radiator 320 and the first radiator 310 are disposed on different surfaces, the two radiators 310 and 320 can be spaced apart by the thickness of the substrate 100. In this situation, the projections of the second radiator 320 and the first radiator 310 on either the first surface 110 or the second surface 120 can partially overlap. By arranging the first radiator 310 and the second radiator 320 to be spaced apart by a predetermined distance, the first radiator 310 can feeds signals to excite the second radiator 320 to form an operating mode for receiving/transmitting wireless signals through coupling effect.

As shown in FIG. 2B, the grounding portion 500 is disposed on the substrate 100 and coupled with the second radiator 320. The grounding portion 500 is preferably disposed on at least one of the first surface 110 and the second surface 120. In this embodiment, the grounding portion 500 is a grounding surface formed of a metal slice which is disposed on the first surface 110. As shown in FIG. 2A, the projections of the second radiator 320 and the grounding portion 500 on the first surface 110 define a semi-open region 400, and the first radiator 310 extends at least partially into the semi-open region. In this embodiment, the semi-open region 400 is an elongated region and the first radiator 310 extends parallel to the edge of the elongated region. Furthermore, the first radiator 310 partially extends outside the coverage of the semi-open region 400. For space utilization, a portion of the first radiator 310 close to an end of the semi-open region 400 is bent to form a folding portion 311, which is bent to extend toward an end of the second radiator 320. However, in another embodiment, the first radiator 310 can be extended out directly without any bends. In the case of not considering the coupling effect between the folding portion 311 and the end of the second radiator 320, the folding portion 311 and the second radiator 320 have to be spaced apart by a suitable distance, such as a distance larger than 1.5 mm. However, in another embodiment, the coupling effect between the ends of the folding portion 311 and the second radiator 320 can be taken into consideration.

In the embodiment shown in FIG. 2A and FIG. 2B, the grounding portion 500 is formed as a rectangular metal surface. The second radiator 320 extends out from a corner of the grounding portion 500. The second radiator 320 includes a root portion 321 and a branch portion 323. An end of the root portion 321 connects to the grounding portion 500, while the other end extends to bend as the branch portion 323. As shown in FIG. 2B, the root portion 321 is perpendicular to the top of the grounding portion 500, while the branch portion 323 is parallel to the top of the grounding portion 500. The root portion 321 and the branch portion 323 together form an inversed L-shape. The root portion 321, the branch portion 323, and the ground portion 500 together define the semi-open region 400 in a shape of a long strip. The semi-open region 400 includes an open for the first radiator 310 extending out. Through the inversed L-shaped design, the volume of the wide-band antenna can be reduced for the purpose of space-saving. However, an inversed F-shape, an S-shape or other geometric shapes can be adopted in the design of the second radiator 320.

The signal feeding portion 700 feeds signals to excite the first radiator 310 and the second radiator 320 to form operating modes for receiving/transmitting wireless signals. As shown in FIG. 2A and FIG. 2B, because the coupling feed-in technique is adopted by the antenna of this invention for feeding signals, the signal feeding portion 700 includes a coupling unit 710. The coupling unit 710 is disposed on the second surface 120 of the substrate 100. The coupling unit 710 is preferably in the form of a metal slice and has an area smaller than that of the first radiator 310. The coupling unit 710 at least partially overlaps the first radiator 310, so that the signal feeding portion 700 feeds signals though the coupling unit 710 to excite the first radiator 310. In other words, the projection of the coupling unit 710 on the first surface 110 at least partially overlaps with the area of the first radiator 310. In this embodiment, the overlap region is within the coverage of the semi-open region 400. Furthermore, by adjusting the shape or the size of the overlap region between the coupling unit 710 and the first radiator 310 can achieve a desired impedance matching.

Figure 3:
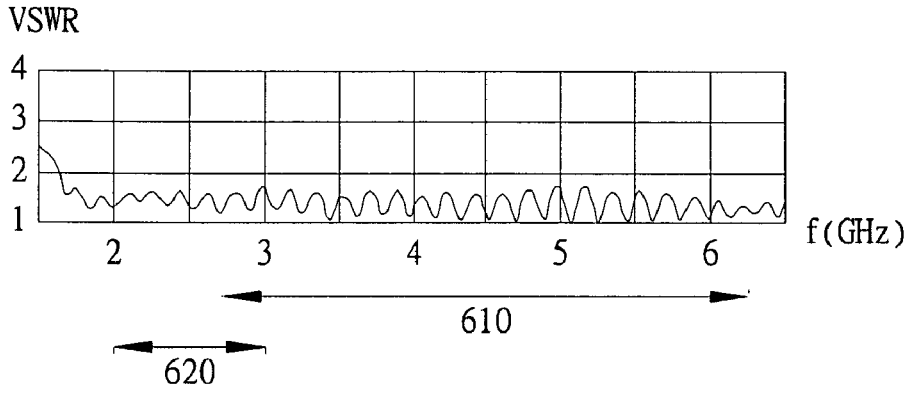
FIG. 3 illustrates a schematic view of the distribution of the voltage standing wave ratio of a wide-band antenna in accordance with one embodiment of the invention.

The signal feeding portion 700 is coupled with the grounding portion 500, and feeds signals to excite the first radiator 310 to form a first band mode through coupling effect by the coupling unit 710. FIG. 3 illustrates a schematic view of the distribution of the voltage standing wave ratio (VSWR) of the wide-band antenna in accordance with one embodiment of the invention. As shown in FIG. 3, a first band mode 610 is a higher frequency mode with a frequency range between 3.3 GHz and 6 GHz. In this embodiment, the voltage standing wave ratio within the frequency range of the first band mode 610 can be controlled under 2. The above-mentioned frequency range is only an exemplary portion of the frequency range of the first band mode 610. Due to the coupling feed-in technique, as shown in FIG. 3, the actual frequency range may exceed the above-mentioned range.

The first radiator 310 further feeds signals to the second radiator 320 to form a second band mode 620 by coupling effect. As shown in FIG. 3, the second band mode 620 is a lower frequency mode compared with the first band mode 610. As shown in FIG. 3, the frequency range of the second band mode 620 is between 2.3 GHz and 2.7 GHz. The above-mentioned range is just an exemplary portion of the frequency range of the second band mode 620. Due to the coupling feed-in technique, as shown in FIG. 3, the actual frequency range may exceed the above-mentioned range.

Furthermore, in this embodiment, the frequency ranges of the first band mode 610 and the second band mode 620 partially overlap to form a wider frequency range. In other words, as shown in FIG. 3, because the frequency ranges of the first band mode 610 and the second band mode 620 partially overlaps, the possible wave peaks produced between each mode can be eliminated, and the voltage standing wave ratio can be controlled under 2. Therefore, an operating mode with the overall frequency range can be considered as a wide-band mode which includes the first band mode 610 and the second band mode 620.

Figure 4:
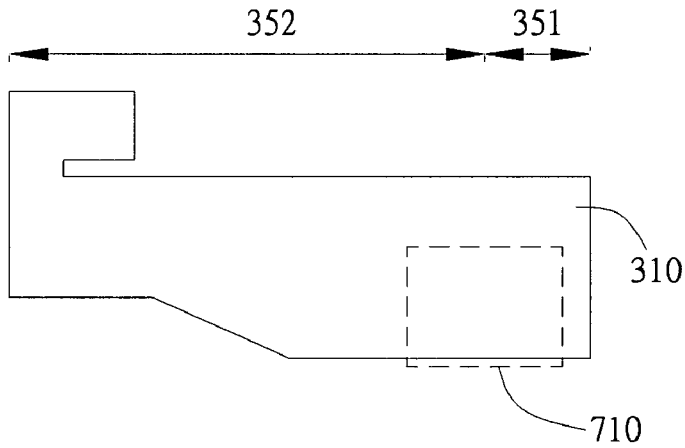
FIG. 4 illustrates a schematic view of an embodiment of a first radiator.

In the embodiment shown in FIG. 4, the first radiator 310 includes a first arm 351 and a second arm 352. In this embodiment, because the first radiator 310 has an elongated shape, the first arm 351 and the second arm 352 represent the left portion and the right portion of the first radiator 310 respectively. The coupling unit 710 overlaps the first radiator 310 including parts of the first arm 351 and the second arm 352. In other words, the first arm 351 and the second arm 352 are respectively located on two sides of the first radiator 310 and extended to two ends. The coupling unit 710 feeds the signal to excite the first arm 351 and the second arm 352 to form a first sub-band mode and a second sub-band mode respectively. In order to adjust the frequency ranges of the first sub-band mode and the second sub-band mode, the overlap position between the coupling unit 710 and the first radiator 310 can be changed to adjust the length or other geometry features of the first arm 351 and the second arm 352. Moreover, the impedance matching can be adjusted by changing the area, the shape, or other geometry features of the overlap region, the first arm 351, and the second arm 352.

Figure 5:
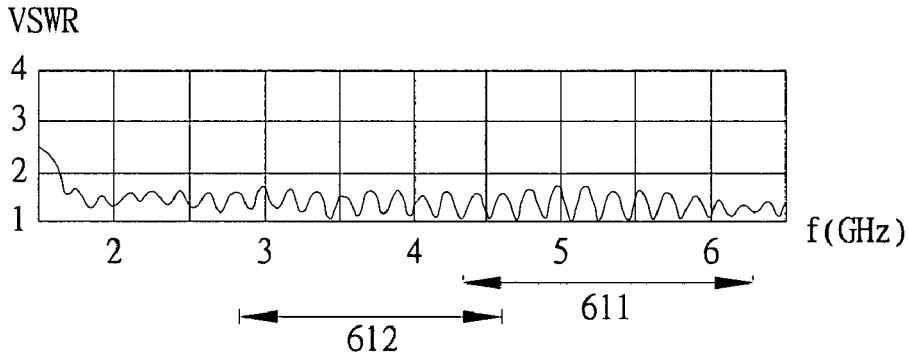
FIG. 5 illustrates a schematic view of the bandwidth distribution of a first sub-band mode and a second sub-band mode in accordance with one embodiment of the invention.

As shown in FIG. 5, the frequency ranges of the first sub-band mode 611 and the second sub-band mode 612 partially overlap and together form the first band mode 610. The first sub-band mode 611 is a mode with a higher frequency which has a frequency range from 5 GHz to 6 GHz. The above-mentioned frequency range is just an exemplary portion of the frequency range of the first sub-band mode 611. Due to the coupling feed-in technique, as shown in FIG. 5, the actual frequency range may exceed the above-mentioned range. Compared with the first sub-band mode 611, the second sub-band mode 612 is a mode with a lower frequency. As shown in FIG. 5, the second sub-band mode 612 has a frequency range from 3.3 GHz to 3.8 GHz. The above-mentioned frequency range is just an exemplary portion of the frequency range of the second sub-band mode 612. Due to the coupling feed-in technique, as shown in FIG. 5, the actual frequency range may exceed the above-mentioned range. Because the frequency ranges of the first sub-band mode 611 and the second sub-band mode 612 partially overlap, the possible wave peaks produced between each mode can be eliminated. Therefore, an operating mode with the overall frequency range can be considered as the first band mode 610 which includes the first sub-band mode 611 and the second sub-band mode 612.

Figure 6A:
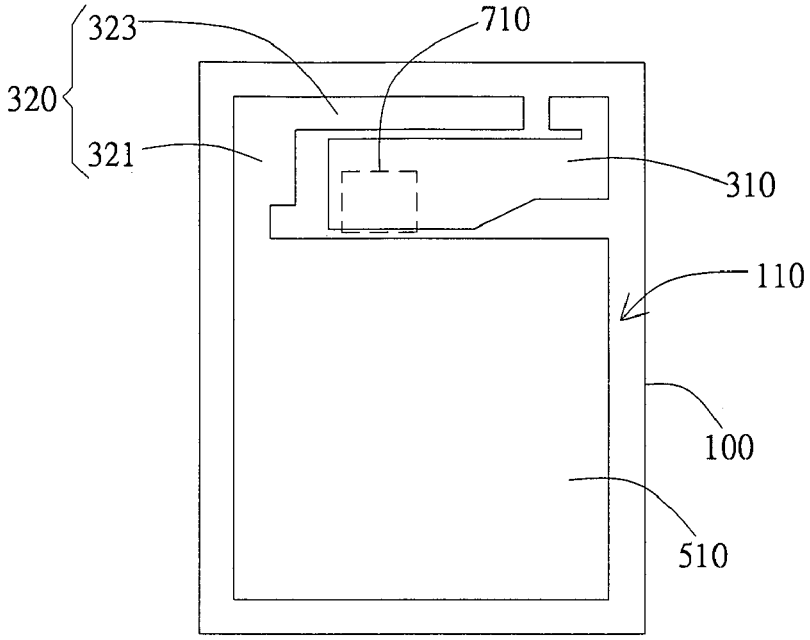
FIG. 6A illustrates a schematic view of the first surface of the wide-band antenna in accordance with another embodiment of the invention.
Figure 6B:
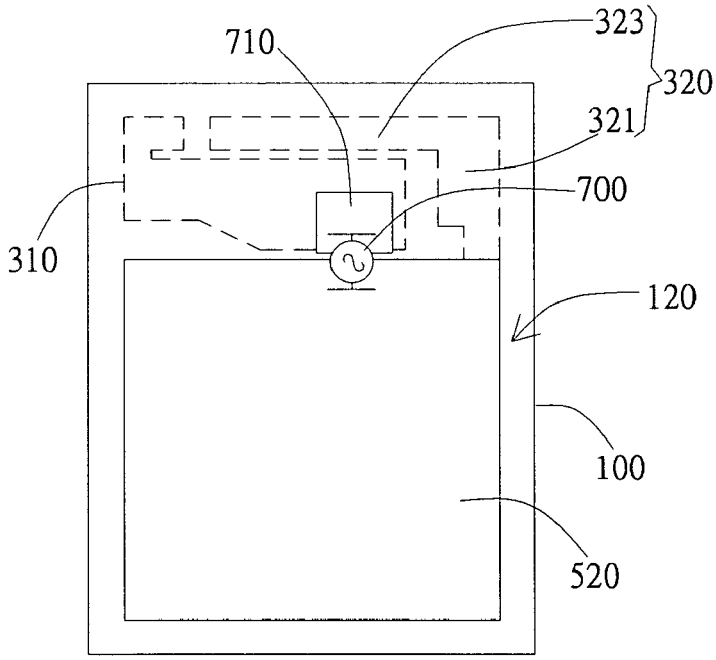
FIG. 6B illustrates a schematic view of the second surface of the embodiment shown in FIG. 6A.

FIG. 6A and FIG. 6B illustrate another embodiment of a wide-band antenna. As shown in FIG. 6A, the second radiator 320 is disposed on the first surface 110 of the substrate 100. In other words, the second radiator 320 and the first radiator 310 are disposed on the same surface in this embodiment. As shown in FIG. 6A, the branch portion 323 of the second radiator 320 is preferably parallel to the main body of the first radiator 310 and spaced apart from the first radiator 310 by an appropriate distance to induce the coupling effect. Since the second radiator 320 and the signal feeding portion 700 are both connected to the grounding portion 500, the grounding portion 500 includes a first grounding surface 510 and a second grounding surface 520 disposed on the first surface 110 and the second surface 120 of the substrate 100 respectively. That is, the signal feeding portion 700 connects to the second grounding surface 520 on the second surface 120, while the second radiator 320 connects to the first grounding surface 510 on the first surface 110. The second grounding surface 520 and the first grounding surface 510 are preferably electrically connected by a conductive hole in the substrate 100. However, the second grounding surface 520 and the first grounding surface 510 can be electrically connected through an external connector in other embodiments. In this embodiment, the first grounding surface 510 and the second grounding surface 520 preferably have same area and same shape and are disposed symmetrically on the first surface 110 and the second surface 120. However, in another embodiment, different geometric shapes and arrangements can be adopted to design the first grounding surface 510 and the second grounding surface 520.

Figure 7:
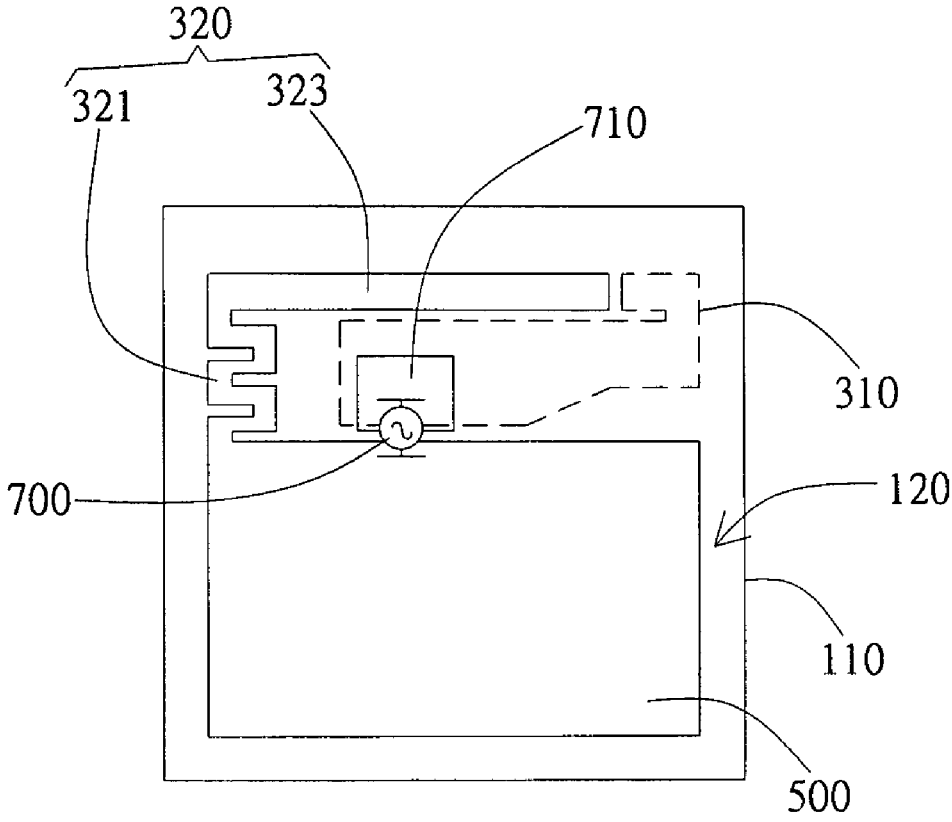
FIG. 7 illustrates a schematic view of another embodiment of a wide-band antenna.

FIG. 7 illustrates another embodiment of a wide-band antenna. In this embodiment, the first radiator 310 and the second radiator 320 are disposed on the first surface 110 and the second surface 120 respectively. However, this embodiment can be applied to the situation when the two radiators are disposed on a same surface. As shown in FIG. 7, the root portion 321 of the second radiator 320 is disposed in the back-and-forth direction on the second surface 120. That is, the root portion 321 is a metal wire disposed in a zigzag-like manner. Through this design, the path length of the second radiator 320 can be increased without increasing space requirement and in turn increase or change the frequency range of the second band mode. Because the portion on the second radiator 320 near the grounding portion 500 has a stronger current distribution, when the zigzag-like design is applied to the root portion 321 near the grounding portion 500, a better performance can be achieved. In another embodiment, the zigzag design can be applied to the branch portion 323 of the second radiating portion 320.

Figure 8A:
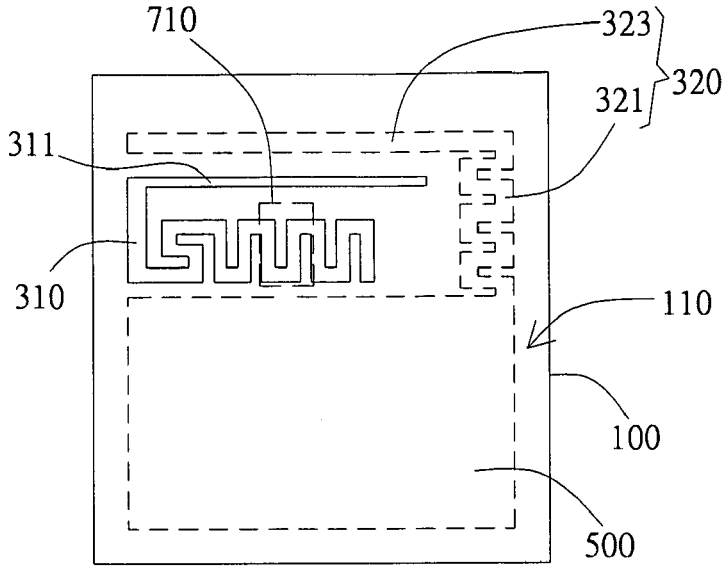
FIG. 8A illustrates a schematic view of the first surface of a wide-band antenna in accordance with another embodiment of the invention.
Figure 8B:
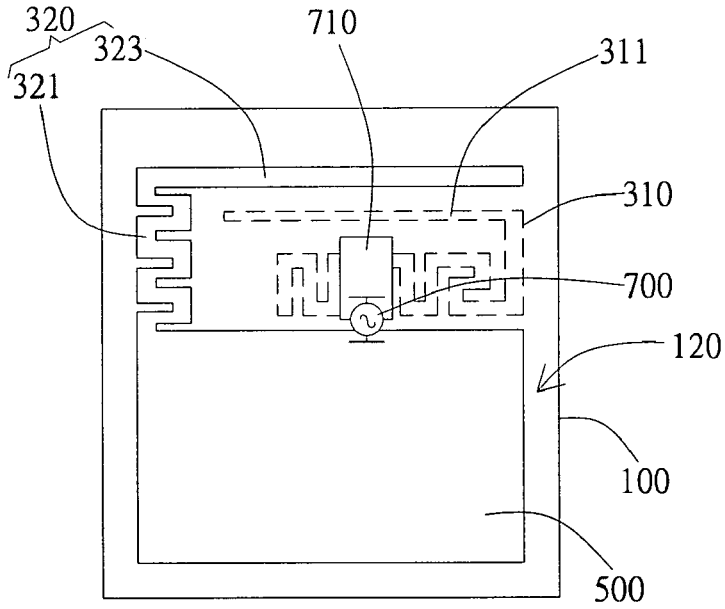
FIG. 8B illustrates a schematic view of the second surface of the embodiment shown in FIG. 8A.

FIG. 8A and FIG. 8B illustrate another embodiment of a wide-band antenna. Compared with the previous embodiment, a zigzag-like design is also applied to the first radiator 310 of this embodiment. Through this design, the path length of the first radiator 310 can be increased without increasing space requirement and in turn increase or change the frequency range of the first band mode. Because a zigzag-like design is adopted by the first radiator 310 and the second radiator 320, the frequency range of a larger antenna can be achieved by a smaller antenna resulting in the size reduction of the antenna. Additionally, in the previous embodiment, the tail end of the first radiator 310 extends outside the semi-open region 400 to form a folding portion 311; however, in the instant embodiment, the folding portion 311 is located in the semi-open region 400 between the zigzag portion of the first radiating portion 310 and the branch portion 323 of the second radiator 320, as shown in FIG. 8A.

Figure 9:
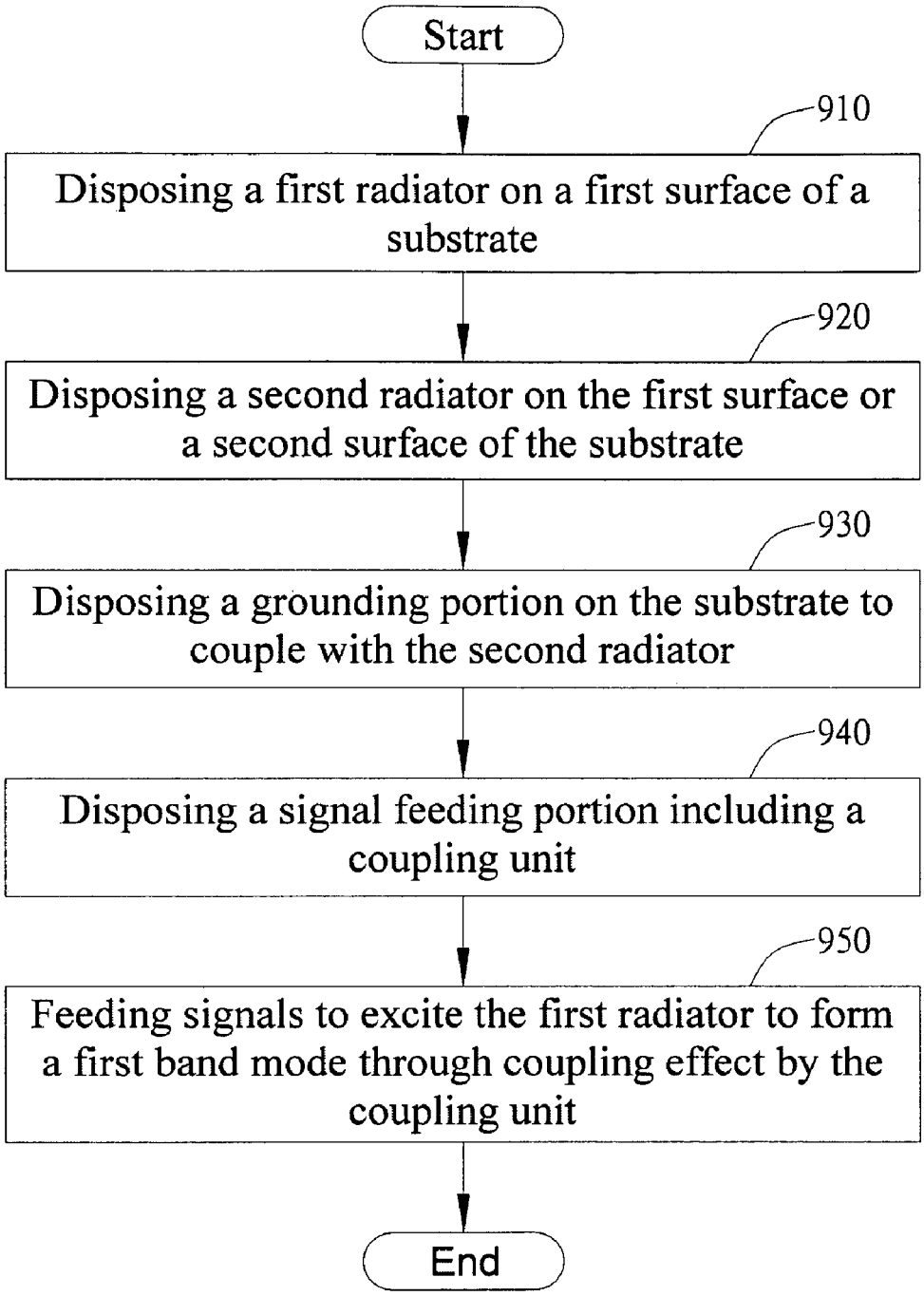
FIG. 9 illustrates a flow chart of a method for manufacturing a wide-band antenna in accordance with one embodiment of the invention.

FIG. 9 illustrates a flow chart of a method for manufacturing the wide-band antenna in accordance with one embodiment of the invention. Step 910 includes disposing a first radiator on a first surface of a substrate. In an embodiment, the first radiator is a metal wire or a metal microstrip in other geometric shapes formed on the first surface and preferably formed on the first surface by printing. However, in other embodiments, other methods such as welding or adhering can be adopted to form the first radiator. Step 920 includes disposing a second radiator on the first surface or a second surface of the substrate, wherein the second radiator and the first radiator are spaced apart by a predetermined distance. In an embodiment, the second radiator is also a metal wire or a metal microstrip with other geometric shapes and preferably formed on the first surface or the second surface by printing. However, in other embodiment, other methods such as welding or adhering can be adopted to form the second radiator.

Step 930 includes disposing a grounding portion on the substrate to couple with the second radiator. In one embodiment, the grounding portion is disposed so that the projections of the second radiator and the grounding portion on the first surface define a semi-open region, and the first radiator extends at least partially into the semi-open region. The grounding portion is preferably formed as a metal slice on the second surface. However, in other embodiments, the grounding portion can be formed by disposing grounding metal slices on the first surface and the second surface simultaneously and coupling the two metal slices by a conductive hole in the substrate or by other suitable manners. Moreover, the first radiator partially extends outside the coverage of the semi-open region. For space utilization, a portion of the first radiator extending outside an end of the semi-open region is bent to form a folding portion which extends toward an end of the second radiator.

Step 940 includes disposing a signal feeding portion including a coupling unit. The signal feeding portion couples with the grounding portion. The coupling unit is disposed on the second surface and at least partially overlaps the first radiator. Step 950 includes feeding signals to excite the first radiator to form a first band mode through coupling effect by the coupling unit. Step 960 includes enabling the first radiator to feed signals to excite the second radiator to form a second band mode through coupling effect. The frequency ranges of the first band mode and the second band mode partially overlap. Because the frequency ranges of the first band mode and the second band mode partially overlap, the possible wave peak produced between each mode can be eliminated, and an operating mode with the overall frequency range can be considered as a wide-band mode which includes the first band mode and the second band mode.

In step 940, in order to make the frequency ranges of the first band mode and the second band mode partially overlap, the frequency ranges of the first band mode and the second band mode can be changed by adjusting the shape, the area, or other geometry features of the overlap region between the coupling unit and the first radiator.

In an embodiment, the step 940 includes overlapping the coupling unit with the first radiator between two ends of the first radiator to define the first radiator with a first arm and a second arm on two sides of the coupling unit respectively. The step 950 includes feeding signals to excite the first arm and the second arm respectively to form a first sub-band mode and a second sub-band mode. The frequency ranges of the first sub-band mode and the second sub-band mode partially overlap and together form the first band mode. In other words, because the frequency ranges of the first sub-band mode and the second sub-band mode partially overlap, the possible wave peak produced between each modes can be eliminated, and an operating mode with the overall frequency range can be considered as the first band mode which includes the first sub-band mode and the second sub-band mode.

Furthermore, in this embodiment, in order to adjust the frequency ranges of the first sub-band mode and the second sub-band mode, the overlap position between the coupling unit and the first radiator can be changed by adjusting the length or other geometry features of the first arm and the second arm. Furthermore, the impedance matching can be adjusted by changing the area, the shape, or other geometry features of the overlap region, the first arm, and the second arm.

Figure 10:
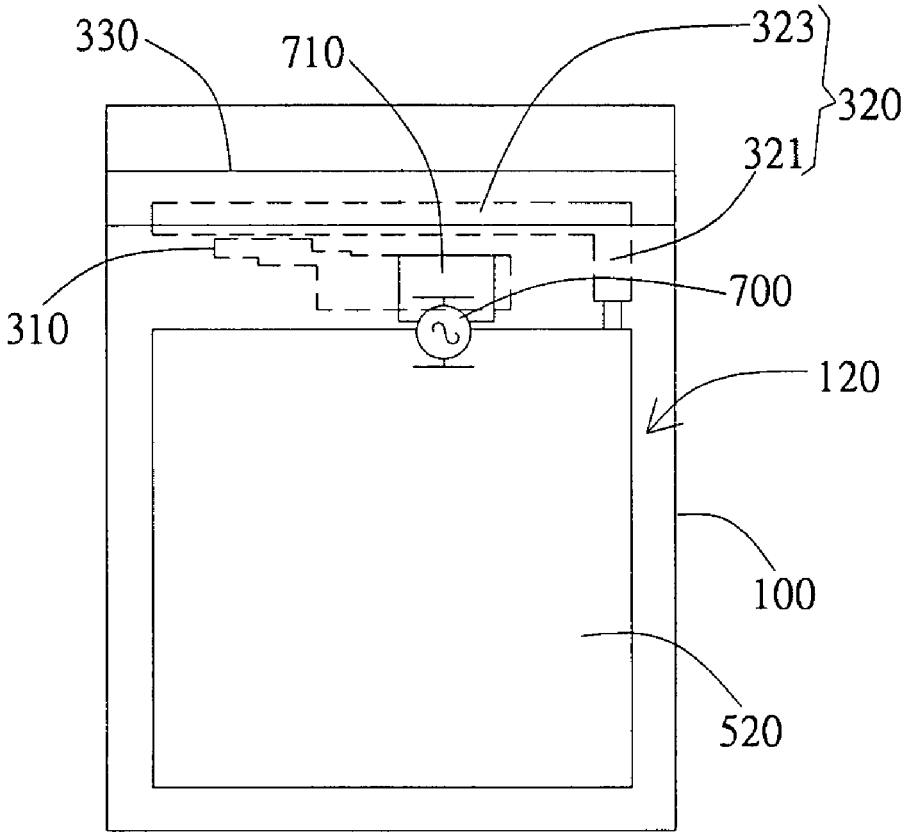
FIG. 10 illustrates a schematic view of an embodiment of a wide-band antenna having a coupling radiator.

FIG. 10 illustrates a schematic view of the wide-band antenna in accordance with another embodiment of the invention. As shown in FIG. 10, the antenna further includes a coupling radiator 330. The coupling radiator 330 and the second radiator 320 are disposed on opposite surfaces of the substrate 100 respectively. For example, in this embodiment, when the second radiator 320 is disposed on the second surface 120 of the substrate 100, the coupling radiator 330 is disposed on the first surface 110. Furthermore, the coupling radiator 330 at least partially overlaps the projection of the second radiator 320 on the first surface 110. In this embodiment, the coupling radiator 330 is parallel to the branch portion 323 of the second radiator 320 and has a length across the substrate 100. The first radiator 310 can be disposed in a step shape in the semi-open region 400. Besides, the width of the coupling radiator 330 is preferably larger than or equal to the width of the second radiator 320 or the branch portion 323. However, in other embodiments, the coupling radiator 330 can be disposed in other manners to produce different coupling effect.

Since the second radiator 320, the first radiator 310, and the coupling unit 710 can excite the coupling radiator 330 by coupling effect, the coupling radiator 330 can produce radiation effect to increase the overall radiation area. Hence, the impedance matching in a system can be improved through the employment of the coupling radiator unit 330, and the efficiency is accordingly enhanced.

Figure 11:
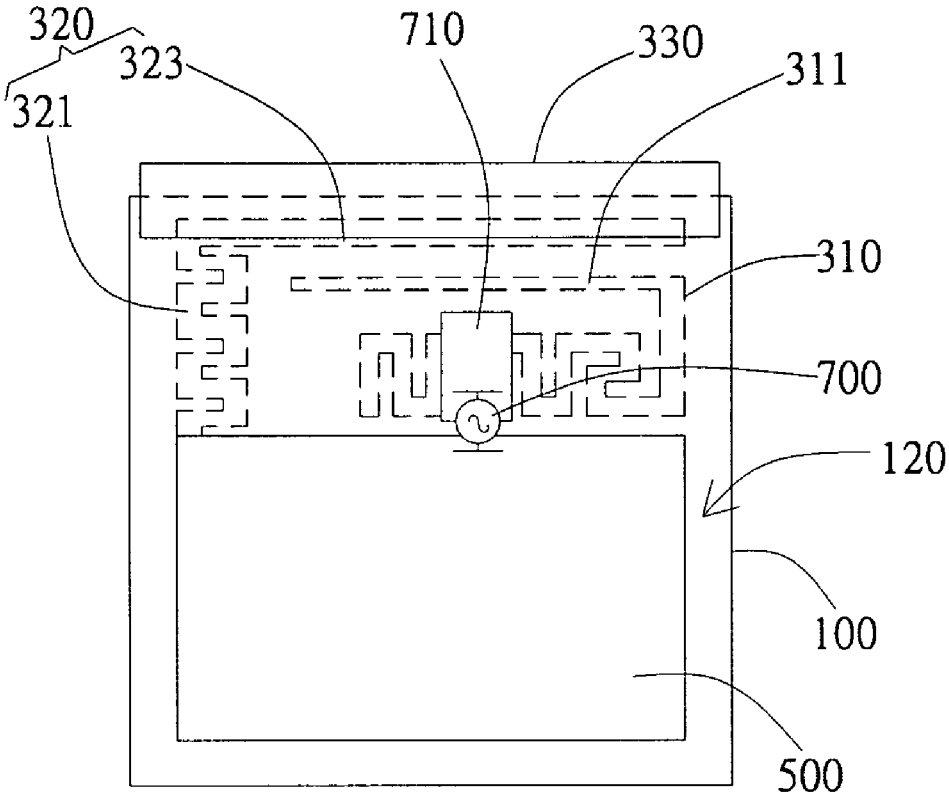
FIG. 11 illustrates a schematic view of another embodiment of a wide-band antenna having a coupling radiator.

In the embodiment as shown in FIG. 11, a portion of the first radiator 310 away from the coupling unit 710 is bent to form a folding portion 311 within the semi-open region 400. The folding portion 311 extends parallel to the branch portion 323 of the second radiator 320. In other words, in this embodiment, the folding portion 311 is also parallel to the coupling radiator 330. Besides, in an embodiment, the area of the coupling radiator 330 is smaller than the sum of the areas of the second radiator 320 and the grounding portion 500. Compared with the embodiment in FIG. 10, the coupling radiator 330 of FIG. 11 has a larger width and extends outside the substrate 100 to increase the radiation area.

Figure 12:
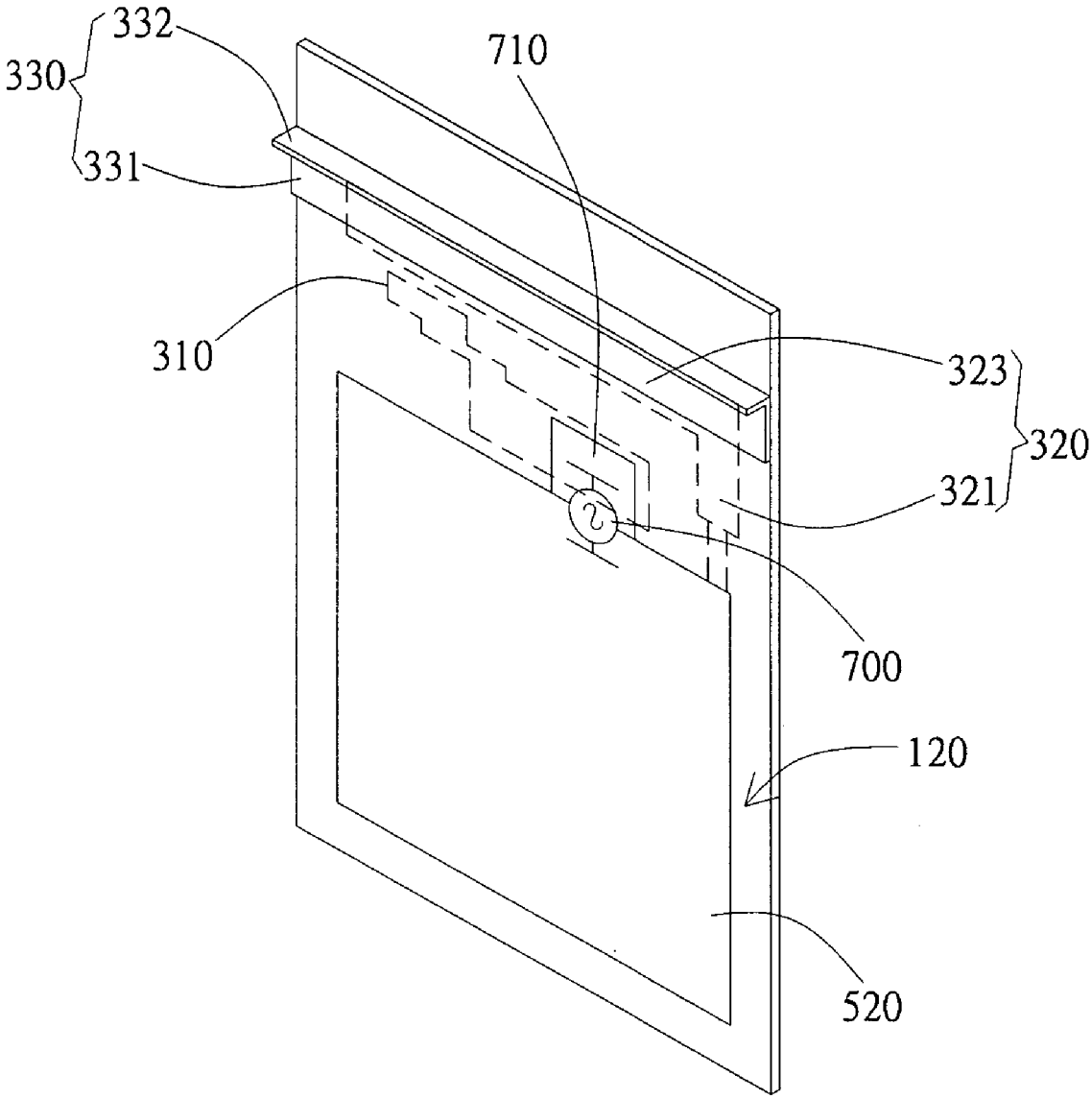
FIG. 12 illustrates a schematic view of an embodiment of a three-dimensional coupling radiator.

In the embodiment as shown in FIG. 12, the coupling radiator 330 includes a main portion 331 and a wing portion 332. As shown in FIG. 12, the coupling radiator 330 is defined as the main portion 331 and the wing portion 332 which is bent from the middle in the extension direction. The main portion 331 connects to the surface of the substrate 100 and at least partially overlaps the projection of the second radiator 320 on the surface. In this embodiment, the main portion 331 is parallel to the branch portion 323 of the second radiator 320 and flatly disposed on the substrate 100. The wing portion 332 is formed through bending an end of the main portion 331. Hence, the coupling radiator 330 has an L-shaped cross-section. An angle is formed between the wing portion 332 and the substrate 100, and the angle is preferably a right angle. That is, the wing portion 332 is preferably perpendicular to the substrate 100. In other words, the wing portion 332 extends out of the surface of the substrate 100 and forms a three-dimensional structure.

Although the present invention has been described through the above-mentioned related embodiments, the above-mentioned embodiments are merely the examples for practicing the present invention. What need to be indicated is that the disclosed embodiments are not intended to limit the scope of the present invention. On the contrary, the modifications within the essence and the scope of the claims and their equivalent dispositions are all contained in the scope of the present invention.

What is claimed is:

1. A wide-band antenna, comprising:

a substrate including a first surface and a second surface, wherein said first and second surfaces are opposite to each other;

a first radiator disposed on said first surface;

a second radiator disposed on either said first surface or said second surface and spaced apart form said first radiator by a predetermined distance;

a grounding portion disposed on said substrate and coupled with said second radiator; wherein the projections of said second radiator and said grounding portion on said first surface define a semi-open region, said first radiator at least partially extends into said semi-open region; and a signal feeding portion including a coupling unit, said coupling unit disposed on said second surface and at least partially overlapping said first radiator; wherein said signal feeding portion couples with said grounding portion and feeds signals to excite said first radiator to form a first band mode through coupling effect by said coupling unit, and said first radiator feeds signals to excite said second radiator to form a second band mode by coupling effect.

2. The wide-band antenna of claim 1, wherein a frequency range of said first band mode and a frequency range of said second band mode partially overlap.

3. The wide-band antenna of claim 1, wherein the overlap region between said first radiator and said coupling unit is within said semi-open region.

4. The wide-band antenna of claim 1, wherein the area of said coupling unit is smaller than that of said first radiator.

5. The wide-band antenna of claim 1, wherein said semi-open region defined by said second radiator and said grounding unit is an elongated region, and said first radiator extends parallel to said elongated region.

6. The wide-band antenna of claim 5, wherein said first radiator extends outside an end of said semi-open region to form a folding portion, and said folding portion extends toward said second radiator.

7. The wide-band antenna of claim 1, wherein said second radiator includes a root portion and a branch portion, an end of said root portion is connected to said grounding portion, while the other end is bent to form said branch portion, and said branch portion, said root portion, and said grounding portion define said semi-open region.

8. The wide-band antenna of claim 7, wherein said root portion is disposed in the back-and-forth direction on said substrate.

9. The wide-band antenna of claim 1, wherein said second radiator and said grounding portion are disposed on said second surface.

10. The wide-band antenna of claim 9, wherein the predetermined distance between said second radiator and said first radiator is the thickness of said substrate, and the projections of said second radiator and said first radiator on said first surface partially overlaps.

11. The wide-band antenna of claim 1, wherein said second radiator is disposed on said first surface, said grounding portion includes a first grounding surface and a said second grounding surface, said first and second grounding surfaces are disposed on said first surface and said second surface respectively, said second radiator is connected to said first grounding surface, and said second grounding surface is electrically connected to said first grounding surface.

12. The wide-band antenna of claim 1, wherein a frequency range of said first band mode is between 3.3 GHz and 6 GHz, and a frequency range of said second band mode is between 2.3 GHz and 2.7 GHz.

13. The wide-band antenna of claim 1, wherein said first radiator includes a first arm and a second arm, said coupling unit overlaps said first radiator including a part of said first arm and a part of said second arm, said first arm and said second arm is fed with signals and excited respectively to form a first sub-band mode and a second sub-band mode by coupling effect, frequency ranges of said first sub-band mode and said second sub-band mode partially overlap and together form said first band mode.

14. The wide-band antenna of claim 13, wherein a portion of the frequency range of said first sub-band mode is between 5 GHz and 6 GHz, and a portion of the frequency range of said second sub-band mode is between 3.3 GHz and 3.8 GHz.

15. A method for manufacturing a wide-band antenna, comprising:

disposing a first radiator on a first surface of a substrate;

disposing a second radiator on either said first surface or a second surface of said substrate to be spaced apart from said first radiator by a predetermined distance;

disposing a grounding portion on said substrate to couple with said second radiator, wherein the projections of said second radiator and said grounding portion on said first surface define a semi-open region, and said first radiator at least partially extending into said semi-open region;

disposing a signal feeding portion including a coupling unit, said coupling unit disposed on said second surface and at least partially overlapping said first radiator, wherein said signal feeding portion is coupled with said grounding portion;

feeding signals to excite said first radiator to form a first band mode through coupling effect by the coupling unit; and enabling said first radiator to excite said second radiator to form a second band mode by coupling effect, wherein frequency ranges of said first band mode and said second band mode partially overlap.

16. The method of claim 15, wherein the step of disposing said signal feeding portion includes adjusting the overlap region between said coupling unit and said first radiator to partially overlap the frequency ranges of said first band mode and said second band mode.

17. The method of claim 15, wherein the step of disposing said signal feeding portion includes adjusting the shape of the overlap region between said coupling unit and said first radiator to partially overlap the frequency ranges of said first band mode and said second band mode.

18. The method of claim 15, wherein the step of disposing said first radiator includes extending said first radiator outside said semi-open region to form a folding portion, and said folding portion extends toward said second radiator.

19. The method of claim 15, wherein the step of disposing said signal feeding portion includes overlapping said coupling unit between two ends of said first radiator to define the first radiator as a first arm and a second arm on two sides of said coupling unit, and wherein the step of forming said first band mode includes feeding signals to excite the first arm and the second arm respectively to form a first sub-band mode and a second sub-band mode, and frequency ranges of said first sub-band mode and said second sub-band mode partially overlaps and together form said first band mode.

20. The method of claim 19, wherein the step of defining said first arm and said second arm includes adjusting the overlap position between said coupling unit and said first radiator to change the frequency ranges of said first sub-band mode and said second sub-band mode.

21. A wide-band antenna, comprising:

a substrate including a first surface and a second surface, wherein said first and second surface are opposite to each other;

a first radiator disposed on said first surface;

a second radiator disposed on either said first surface or said second surface and spaced apart from said first radiator by a predetermined distance;

a coupling radiator, said coupling radiator and said second radiator being disposed on opposite surfaces of the substrate respectively, wherein said coupling radiator at least partially overlaps the projection of said second radiator on either said second surface or said first surface;

a grounding portion disposed on said substrate to couple with said second radiator, wherein the projections of said second radiator and said grounding portion define a semi-open region on said first surface, and said first radiator at least partially extends into said semi-open region; and a signal feeding portion including a coupling unit, said coupling unit being disposed on said second surface and at least partially overlapping with said first radiator, wherein said signal feeding portion is coupled with said grounding portion and feeds signals to excite said first radiator to form a first band mode through coupling effect by said coupling unit, and said first radiator feeds signals to excite said second radiator to form a second band mode by coupling effect.

22. The wide-band antenna of claim 21, wherein the overlap region between said first radiator and said coupling unit is within said semi-open region.

23. The wide-band antenna of claim 21, wherein said semi-open region defined by said second radiator and said grounding unit is an elongated region, and said first radiator extends parallel to the elongated region.

24. The wide-band antenna of claim 21, wherein said first radiator is bent to form a folding portion in said semi-open region, and said folding portion extends parallel to said second radiator.

25. The wide-band antenna of claim 21, wherein said second radiator includes a root portion and a branch portion, an end of said root portion is connected to said grounding portion while the other end is bent to form said branch portion, and said branch portion, said root portion, and said grounding portion define said semi-open region.

26. The wide-band antenna of claim 25, wherein said coupling radiator is parallel to said branch portion.

27. The wide-band antenna of claim 26, wherein the width of said coupling radiator is larger than that of said branch portion.

28. The wide-band antenna of claim 21, wherein the area of said coupling radiator is smaller than the sum of the areas of said second radiator and said grounding portion.

29. The wide-band antenna of claim 21, wherein said coupling radiator includes a main portion and a wing portion, said main portion is connected to said substrate and at least partially overlaps the projection of said second radiator, and said wing portion is bent from said main portion to form an angle with respect to the surface of said substrate.

* * * * *